US009384684B2

(12) United States Patent
Theisen et al.

(10) Patent No.: US 9,384,684 B2
(45) Date of Patent: Jul. 5, 2016

(54) SHELF-TYPE DISPLAY MODULE

(71) Applicant: Target Brands, Inc., Minneapolis, MN (US)

(72) Inventors: Jennifer A. Theisen, Crystal, MN (US); William Y. Stafford, Minnetrista, MN (US); Erin L. Zobel, Minneapolis, MN (US); Timothy J. Martell, Brooklyn Park, MN (US); Benjamin Weshler, New York, NY (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/547,778

(22) Filed: Nov. 19, 2014

(65) Prior Publication Data

US 2015/0076093 A1 Mar. 19, 2015

Related U.S. Application Data

(62) Division of application No. 13/786,924, filed on Mar. 6, 2013, now Pat. No. 8,925,745.

(51) Int. Cl.
*A47F 1/04* (2006.01)
*A47F 7/00* (2006.01)
(Continued)

(52) U.S. Cl.
CPC ..... *G09F 3/204* (2013.01); *A47B 47/022* (2013.01); *A47B 57/585* (2013.01);
(Continued)

(58) Field of Classification Search
CPC ... A47F 5/0018; A47F 5/0093; A47F 5/0025; A47F 1/126; A47F 5/16; A47F 5/0043; A47F 5/103; A47F 5/005; A47F 1/125; A47F 1/08; A47F 2005/165; A47F 3/001; A47B 96/021; A47B 96/027; A47B 57/585; A47B 47/022; Y10T 29/49826; Y10T 29/49817; G09F 3/204; F21V 33/00; F21Y 2101/00; F21Y 2103/00; F21Y 2105/00; F21Y 2111/00; F21Y 2113/00
USPC ..... 211/119.003, 85.26, 134; 40/642.02, 40/658, 647, 661, 661.06, 661.03, 651, 40/101; 248/220.22, 223.41; 362/127, 362/134, 154, 234, 249.01, 362, 382
See application file for complete search history.

(56) References Cited

U.S. PATENT DOCUMENTS 1,978,636 A 10/1934 Keil
2,172,528 A * 9/1939 Auer ..... G03B 42/047 101/380

(Continued)

OTHER PUBLICATIONS

Office Action from Canadian Patent Application No. 2,811,284, mailed Sep. 9, 2013, 3 pages.

(Continued)

*Primary Examiner* — Jennifer E Novosad
(74) *Attorney, Agent, or Firm* — Leanne Taveggia Farrell; Westman, Champlin & Koehler, P.A.

(57) ABSTRACT

A shelf-type display module includes a carrier tray assembly including a carrier tray having a top, a bottom, a plurality of tracks and at least one light. The plurality of tracks protrude from the top of the carrier tray and the at least one light is mounted to the bottom of the carrier tray. An insert tray includes a main body having components for holding products for display and components for mating with the plurality of tracks on the carrier tray. The components of the main body that mate with the plurality of tracks on the carrier tray slide along the plurality of tracks from a right side to a left side of the carrier tray or from the left side to the right side of the carrier tray.

17 Claims, 11 Drawing Sheets

(51) Int. Cl.

| | |
|---|---|
| ***A47F 5/08*** | (2006.01) |
| ***A47F 5/00*** | (2006.01) |
| ***A47B 43/00*** | (2006.01) |
| ***A47B 47/00*** | (2006.01) |
| ***A47B 57/00*** | (2006.01) |
| ***A47F 5/16*** | (2006.01) |
| ***A47F 1/12*** | (2006.01) |
| ***A47B 47/02*** | (2006.01) |
| ***A47B 57/58*** | (2006.01) |
| ***A47B 96/02*** | (2006.01) |
| ***F21V 33/00*** | (2006.01) |
| ***G09F 3/20*** | (2006.01) |
| ***A47F 3/00*** | (2006.01) |
| *A47F 1/08* | (2006.01) |
| *A47F 5/10* | (2006.01) |

(52) U.S. Cl.

CPC ..... *A47B 96/021* (2013.01); *A47B 96/027* (2013.01); *A47F 1/126* (2013.01); *A47F 3/001* (2013.01); *A47F 5/0018* (2013.01); *A47F 5/0025* (2013.01); *A47F 5/0043* (2013.01); *A47F 5/0093* (2013.01); *A47F 5/16* (2013.01); *F21V 33/00* (2013.01); *A47F 1/08* (2013.01); *A47F 1/125* (2013.01); *A47F 5/005* (2013.01); *A47F 5/103* (2013.01); *A47F 2005/165* (2013.01); *Y10T 29/49817* (2015.01); *Y10T 29/49826* (2015.01)

(56) References Cited

U.S. PATENT DOCUMENTS 2,730,825 A * 1/1956 Wilds ..... G09F 3/20 211/49.1
2,827,718 A * 3/1958 Howard ..... G09F 3/20 40/658
3,084,463 A * 4/1963 Guyer ..... G09F 3/20 40/564
3,862,506 A * 1/1975 Drenten ..... G09F 3/204 40/325
4,164,009 A 8/1979 Maguire, Jr. et al.
4,334,372 A * 6/1982 Colmar ..... G09F 3/20 40/5
4,429,796 A 2/1984 Sussman
4,688,341 A * 8/1987 Castel ..... G09F 3/20 40/486
4,747,025 A 5/1988 Barton
4,762,235 A 8/1988 Howard et al.
4,925,038 A 5/1990 Gajewski
4,994,943 A 2/1991 Aspenwall
5,011,018 A 4/1991 Keffeler
5,012,936 A 5/1991 Crum
5,085,154 A 2/1992 Merl
5,088,607 A 2/1992 Risafi et al.
5,265,735 A 11/1993 Hassel et al.
5,330,063 A 7/1994 Remmers
5,390,802 A 2/1995 Pappagallo et al.
5,392,547 A * 2/1995 Mason ..... G09F 3/204 40/5
5,445,280 A 8/1995 Rahn
5,611,442 A 3/1997 Howard
5,626,243 A 5/1997 Brozak, Jr.
5,626,246 A 5/1997 Roddy et al.
5,657,880 A 8/1997 Birnbaum
5,673,801 A 10/1997 Markson
5,690,415 A * 11/1997 Krehl ..... A47F 5/101 108/23
5,746,328 A 5/1998 Beeler et al.
5,758,585 A 6/1998 Latchinian
6,000,611 A * 12/1999 Dalton ..... G09F 3/204 235/383
6,035,569 A * 3/2000 Nagel ..... A47F 5/0068 40/649
6,041,720 A 3/2000 Hardy
6,082,557 A 7/2000 Leahy
6,119,990 A * 9/2000 Kump ..... A47F 5/0068 211/57.1
6,126,125 A * 10/2000 Dalton ..... G09F 3/208 248/205.2
6,226,910 B1 * 5/2001 Ireland ..... G09F 3/204 40/651
6,357,606 B1 3/2002 Henry
6,364,136 B1 4/2002 Weshler et al.
6,364,273 B1 4/2002 Otema
6,409,027 B1 6/2002 Chang et al.
6,431,721 B2 8/2002 Shemitz et al.
6,481,133 B1 * 11/2002 DeSena ..... G09F 3/204 40/649
6,484,891 B2 11/2002 Burke
6,497,329 B1 * 12/2002 Johnson ..... A47F 5/0018 206/459.5
6,568,112 B2 * 5/2003 Lowry ..... G09F 3/204 40/649
6,571,498 B1 * 6/2003 Cyrluk ..... G09F 3/204 108/27
6,688,567 B2 * 2/2004 Fast ..... G09F 3/204 211/57.1
6,827,465 B2 12/2004 Shemitz et al.
6,883,671 B2 4/2005 Rushing
6,935,060 B2 * 8/2005 Bjerke ..... G09F 3/204 248/220.22
6,935,062 B2 * 8/2005 Lowry ..... G09F 3/204 248/205.1
6,971,201 B2 * 12/2005 Brinkman ..... G09F 3/0295 248/231.81
7,131,543 B2 11/2006 Mason
7,163,305 B2 1/2007 Bienick
7,308,987 B2 12/2007 Richardson et al.
7,325,348 B2 * 2/2008 Mueller ..... G09F 3/204 40/649
7,340,855 B2 * 3/2008 Wiltfang ..... G09F 3/204 248/220.21
7,386,950 B2 * 6/2008 Fast ..... G09F 3/204 40/642.02
7,434,951 B2 10/2008 Bienick
D579,984 S * 11/2008 Bruegmann ..... D20/43
7,455,081 B2 * 11/2008 Bacnik ..... G09F 3/204 40/642.02
7,574,822 B1 * 8/2009 Moore ..... G09F 3/204 40/575
7,591,382 B2 9/2009 Brock
7,628,525 B2 12/2009 Lee et al.
7,686,265 B2 * 3/2010 Hall ..... F16B 2/04 24/289
7,726,057 B2 * 6/2010 Brinkman ..... G09F 3/204 248/220.21
7,824,055 B2 11/2010 Sherman
7,882,969 B2 * 2/2011 Gerstner ..... A47F 3/14 211/119.003
7,909,183 B2 3/2011 Oh
7,913,861 B2 3/2011 Mueller et al.
7,992,728 B2 8/2011 Burgess et al.
8,087,522 B2 1/2012 Stafford et al.
8,172,096 B2 * 5/2012 Van De Steen ..... A47B 96/02 211/119.003
8,215,795 B2 7/2012 Pichel
8,443,988 B2 5/2013 Niederhuefner
8,646,935 B2 2/2014 Karan
8,763,819 B2 7/2014 Theisen et al.
8,793,913 B1 * 8/2014 Zobel ..... G09F 3/204 40/661.03
8,925,745 B2 * 1/2015 Theisen ..... A47F 5/0043 211/10
9,060,624 B2 * 6/2015 Hardy ..... A47F 5/005
2001/0010302 A1 8/2001 Nickerson
2004/0118795 A1 6/2004 Burke
2004/0226203 A1 11/2004 Yenglin et al.
2005/0193612 A1 * 9/2005 Lowry ..... G09F 3/204 40/661.03
2006/0048419 A1 3/2006 Yenglin et al.
2006/0049122 A1 3/2006 Mueller et al.
2007/0068885 A1 3/2007 Busto et al.

(56) References Cited

U.S. PATENT DOCUMENTS

| | | | |
|---|---|---|---|
| 2007/0108142 | A1 | 5/2007 | Medcalf et al. |
| 2007/0138114 | A1 | 6/2007 | Dumontet |
| 2007/0272634 | A1 | 11/2007 | Richter et al. |
| 2008/0121146 | A1 | 5/2008 | Burns et al. |
| 2010/0258513 | A1 | 10/2010 | Meyer et al. |
| 2011/0100941 | A1 | 5/2011 | Luberto et al. |
| 2011/0100942 | A1 | 5/2011 | Spizman et al. |
| 2011/0174750 | A1 | 7/2011 | Poulokefalos |
| 2011/0204009 | A1 | 8/2011 | Karan |
| 2011/0315645 | A1 | 12/2011 | Fadrowski |
| 2012/0012547 | A1 | 1/2012 | Bergdoll et al. |
| 2015/0068086 | A1 * | 3/2015 | Theisen ..... G09F 3/204 40/661.06 |

OTHER PUBLICATIONS

Office Action from Canadian Patent Application No. 156,840, mailed Jun. 11, 2014, 1 page.

Office Action from Canadian Patent Application No. 150,458 mailed Jun. 17, 2014, 1 page.

* cited by examiner

SHELF-TYPE DISPLAY MODULE

CROSS-REFERENCE TO RELATED APPLICATIONS

The present application is a divisional of and claims priority to U.S. patent application Ser. No. 13/786,924, filed Mar. 6, 2013, the content of which is hereby incorporated by reference in its entirety.

BACKGROUND

Retail stores use a variety of display fixtures to present products to customers for purchase. These display fixtures can support the product, indicate the product price and include signage, graphics and lighting for highlighting the product. Exemplary display structures include shelves, trays, racks, peg hooks and other similar structures.

The discussion above is merely provided for general background information and is not intended to be used as an aid in determining the scope of the claimed subject matter.

SUMMARY

A shelf-type display module includes a carrier tray assembly including a carrier tray having a top, a bottom, a plurality of tracks and at least one light. The plurality of tracks protrude from the top of the carrier tray and the at least one light mounted to the bottom of the carrier tray. An insert tray includes a main body having components for holding products for display and components for mating with the plurality of tracks on the carrier tray. The components of the main body that mate with the plurality of tracks on the carrier tray slide along the plurality of tracks from a right side to a left side of the carrier tray or from the left side to the right side of the carrier tray.

The shelf-type display module includes a base assembly having a base for supporting product in a retail store and a detachable front assembly. The detachable front assembly includes a main body detachably mounted to a front of the base, a fanfold extrusion housed in the main body of the detachable front assembly and a cover rotatably coupled to the main body. The fanfold extrusion includes at least two label sleeves for receiving labels that provide relevant information to employees about the products being supported by the base. The cover encloses the fanfold extrusion within the main body and including a lens mounted to a lens back plate. A graphic is sandwiched between the lens and the lens back plate and provides relevant information to customers about the products being supported by the base.

A method of assembling a shelf-type display module includes obtaining a carrier tray having a top, a bottom and a set of tracks that protrude from the top of the carrier tray. The insert tray is side-loaded onto the carrier tray. The insert tray includes a main body having components for displaying products and components for engaging with the set of tracks on the carrier tray.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The display modules described below are shelf-type display structures that when mounted together on a wall of a gondola display unit form a display fixture. Each display module includes the same base component and a select one of a plurality of alternative trays that is mounted to the base component to form the display module. Each display module aids in the display of retail products, such as beauty supplies. Exemplary beauty supplies include nail polish, lipsticks, lip glosses, eye shadows, rouge, bronzers, make-up bases and powders, lotions and etc.

More specifically, each display module includes a carrier tray assembly and an insert tray. The carrier tray assembly includes a carrier tray, a pair of shelf brackets and a detachable front assembly. The detachable front assembly retains various components that hold and display labels that provide relevant information to employees about the products being supported by the carrier tray assembly. The insert tray mounts to the carrier tray of the carrier tray assembly and can be selected from a plurality of different insert trays depending on the product or products that need to be displayed.

Figure 1:
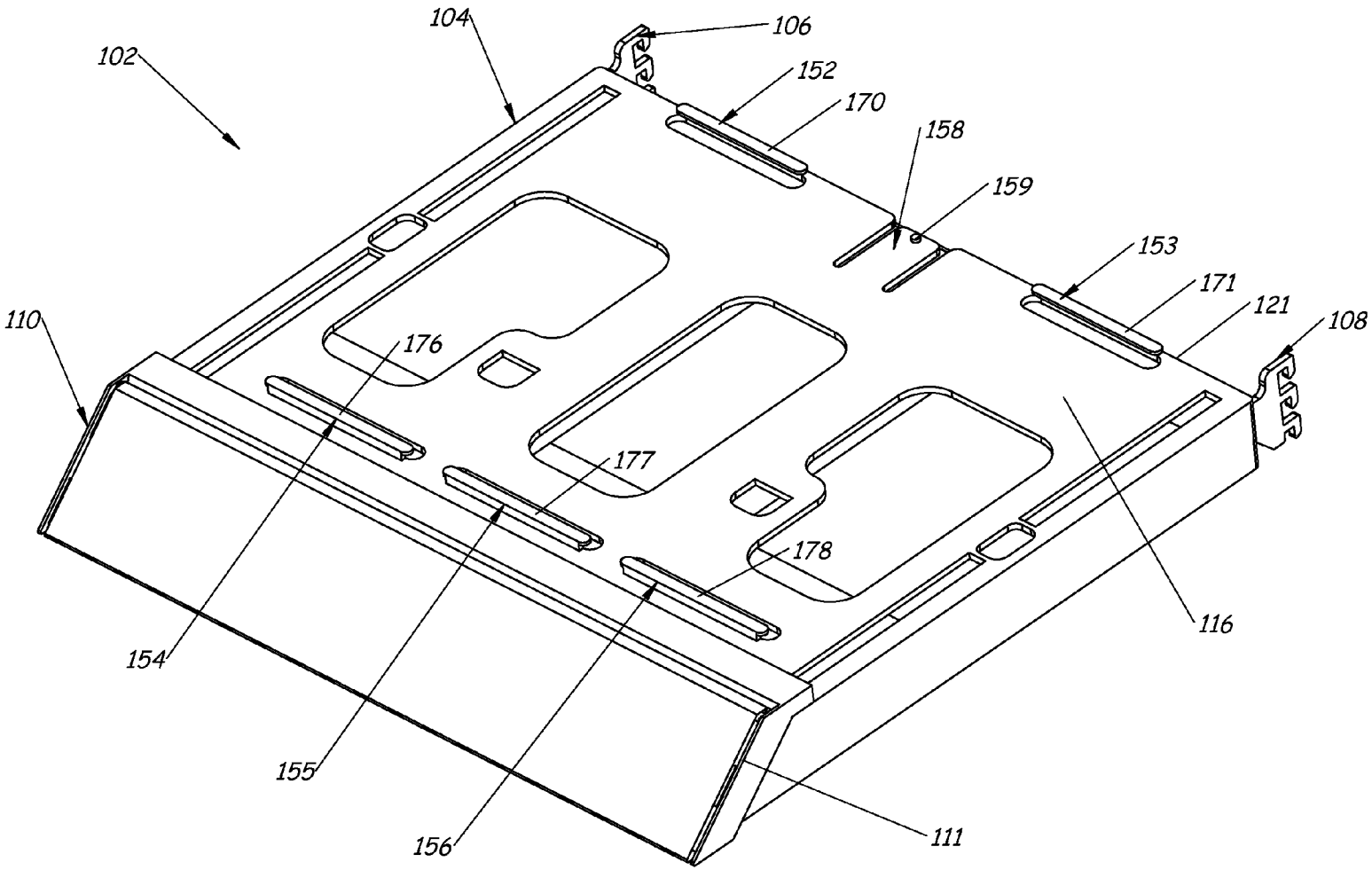
FIG. 1 is a perspective view of a carrier tray assembly or base assembly according to one embodiment.
Figure 2:
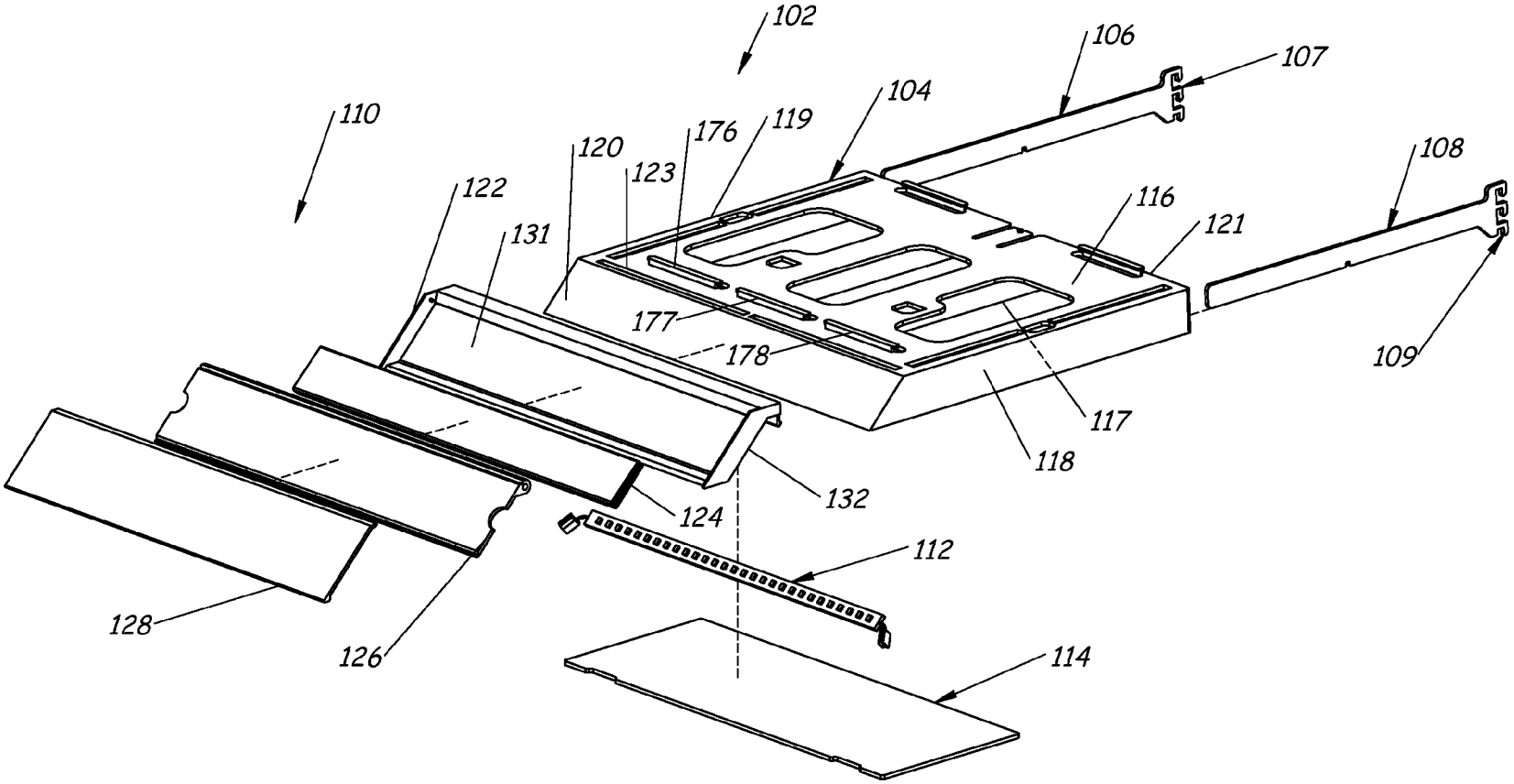
FIG. 2 is an exploded perspective view of the carrier tray assembly or base assembly illustrated in FIG. 1.

FIG. 1 is a perspective view of a carrier tray assembly or base assembly 102 according to one embodiment. FIG. 2 illustrates an exploded perspective view of carrier tray assembly or base assembly 102 illustrated in FIG. 1. Carrier tray assembly 102 includes a carrier tray or base 104, a pair of shelf brackets or arms 106 and 108, a detachable front assembly 110, a plurality of lights 112 (such as a LED lighted strip assembly) and a diffuser 114. Carrier tray 104 can be plastic injection molded using a polymer, such as an opaque styrene. Carrier tray 104 provides a support structure having a top 116, a bottom 117, a right side 118, a left side 119, a front 120 and a back 121. Carrier tray 104 provides structural elements for holding and retaining the pair of shelf brackets 106 and 108, detachable front assembly 110, the plurality of lights 112 and diffuser 114.

For example, the pair of shelf brackets 106 and 108 can be made of a conductive material, such as metal, and mounted within carrier tray 104 so that a portion of shelf brackets 106 and 108, which have a plurality of fingers 107 and 109 that extend backward from back 121, are configured to attach to concealed standards on a powered back panel that couples to a wall of a gondola display unit. More particularly, fingers 107 and 109 not only mechanically attach carrier tray assembly 102 to the concealed standards on the powered back panel, but fingers 107 and 109 also electrically connect with the concealed standards on the powered back panel. Behind fascia panels on the powered back panel includes circuitry and wiring for conducting electricity. Upon making the appropriate electrical connection, the pair of shelf brackets complete a circuit designed to power the plurality of lights 112. In particular, one end of lights 112 is electrically connected to bracket 106 and the other end of lights 112 is electrically connected to bracket 108 such that current flows between bracket 106 and bracket 108 through lights 112 causing lights 112 to product light. Carrier tray 104 acts as an insulator and does not conduct electricity between bracket 106 and bracket 108. The plurality of lights 112 are coupled to bottom 117 of carrier tray 104 and are covered by diffuser 114, which is also attached to bottom 117 of carrier tray 104. In this way, the plurality of lights 112 not only cast light downward through diffuser 114 to illuminate products being supported by the carrier tray assemblies located below, but can also cast light upward and through at least a portion of detachable front assembly 110 when detachable front assembly 110 is attached to front 120 of carrier tray 104.

Figure 4:
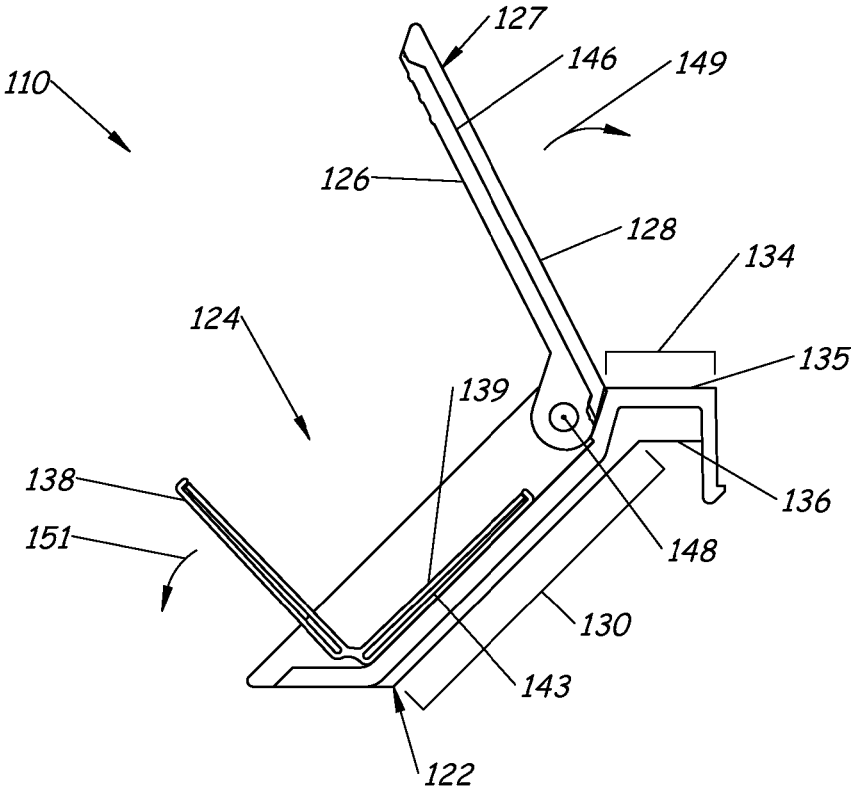
FIG. 4 is a side view of a detachable front assembly of the carrier tray assembly or base assembly illustrated in FIGS. 1 and 2 with a cover and a fanfold extrusion in open positions.

Detachable front assembly 110 includes a main body 122, a fanfold extrusion 124, a lens back plate 126 and a lens 128. Main body 122 mounts to front 120 of carrier tray 104 and can be plastic injection molded using a polymer, such as styrene. It should be noted that components on carrier tray 104 that receive the detachable components on detachable front assembly 110 are not illustrated. Like front 120 of carrier tray 104, main body 122 includes an angled component 130 (FIG. 4) having a front 131 and a back 132. Back 132 of angled component 130 mates with front 120 of carrier tray 104. In addition, main body 122 includes an upper component 134 (FIG. 4) having a top 135 (FIG. 4) and a bottom 136 (FIG. 4). Bottom 136 mates with a portion of top 116 of carrier tray 104. More particularly, upper component 134 of main body 122 is made of a transparent material, such as clear styrene. Light from the plurality of lights 112 casts through an opening 123 or openings in carrier tray 104 and is then allowed to filter through upper component 134 to illuminate a portion of the top of carrier tray 104.

Figure 3:
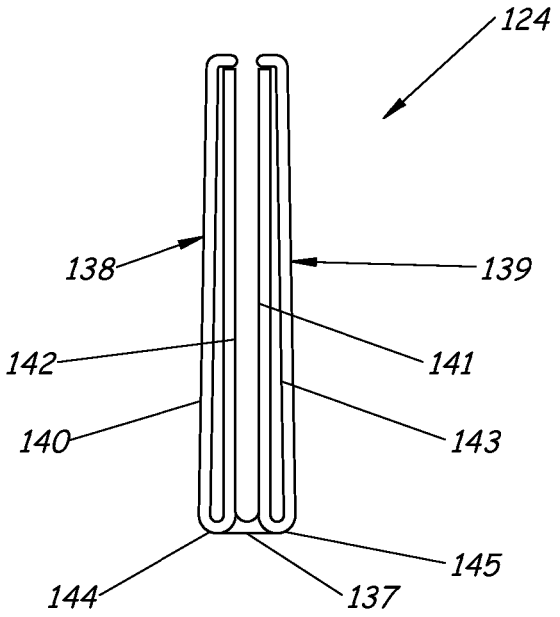
FIG. 3 is an enlarged side view of a fanfold extrusion of the carrier tray assembly or base assembly illustrated in FIGS. 1 and 2.

FIG. 3 illustrates a side view of fanfold extrusion 124. Fanfold extrusion 124 is made of a single, continuous and extruded polymer, such as a transparent polyvinyl chloride, and includes first and second label sleeves 138 and 139 coupled together by a hinge 137. Each label sleeve 138 and 139 includes a front piece 140 and 141 coupled to a back piece 142 and 143 by a bottom connecting piece 144 and 145. As illustrated in FIG. 3, front piece 140 of first label holder 138 has a substantially identical shape to back piece 143 of second label holder 139, however, back piece 143 of second label holder 139 is arranged such that it mirrors front piece 140 of first label holder 138. Likewise, front piece 141 of second label holder 139 is arranged such that it mirrors back piece 142 of first label holder 138. In other words, the material of fanfold extrusion 124 extends along front piece 140 of label sleeve 138, turns at bottom connecting piece 144 and extends along back piece 142 of label sleeve 138 such that bottom connecting piece 144 encloses the bottom of first sign sleeve 138 and the tops of front piece 140 and back piece 142 bias together to hold a label in place. The material of fanfold extrusion 124 also extends along back piece 143 of label sleeve 139, turns at bottom connecting piece 145 and extends along front piece 141 of label sleeve 139 such that bottom connecting piece 145 encloses the bottom of second sign sleeve 139 and the tops of front piece 141 and back piece 143 bias together to hold a label in place. Still further and as discussed above, the single, continuous material of fanfold extrusion 124 includes hinge 137, which connects bottom connecting piece 144 of label sleeve 138 to bottom connecting piece 145 of label sleeve 139.

Together, lens back plate 126 and lens 128 provide a cover 127 (FIG. 4) to main body 122 so as to enclose and hide fanfold extrusion 124 from public view. Lens back plate 126 can be made of an injection molded plastic, such as an opaque styrene and lens 128 can be made of an injection molded plastic, such as a transparent NAS (a copolymer of polystyrene and acrylic). Lens 128 is mounted to lens back plate 126 and sandwiched between them is a graphic 146 (FIG. 4). Graphic 146 provides relevant information to customers about the products that are being displayed on carrier tray assembly 102 including, for example, brand name, product type, and illustrations of product colors and color names.

FIG. 4 illustrates a side view of detachable front assembly 110 in an open position with the end cap 111 (FIG. 1) removed for purposes of clarity. As illustrated, back piece 143 of fanfold extrusion 124 is attached to front 131 (FIG. 2) of angled component 130. For example, back piece 143 of fanfold extrusion can be attached to front 131 of angled component 130 using an adhesive. In addition, cover 127 is rotatably mounted to detachable front 122 (FIG. 2) about a proximal end or axis 148 and a distal end of cover 127 is a free end. Therefore and as illustrated by directional arrow 149 in FIG. 4, the labels in fanfold extrusion 124 are accessed by first rotating cover 127 about proximal end or axis 148. Although not illustrated in FIG. 4, in this open position, the labels located in label sleeve 138 are viewable and scannable. In one embodiment, the labels located in label sleeve 138 provide relevant information to employees about the products that carrier tray assembly 102 is displaying including, for example, a price, a product description identifier, such as a DPCI (Department Class Item) number and associated bar codes. The labels located in label sleeve 139 are then accessed by rotating label sleeve 138 about hinge 140 as illustrated in FIG. 4 by directional arrow 151. In this open position, the labels located in label sleeve 139 are viewable and scannable. The labels in label sleeve 139 also provide relevant information to employers about the products that carrier tray assembly 102 is displaying including, for example, a price, a product description identifier, such as a DPL number and associated bar codes. In one embodiment, two label sleeves 138 and 139 are included in order to fit all of the separate labels for describing product supported by carrier tray 104. However, it should be realized that any number of label sleeves in fanfold extrusion 124 are possible.

Figure 5:
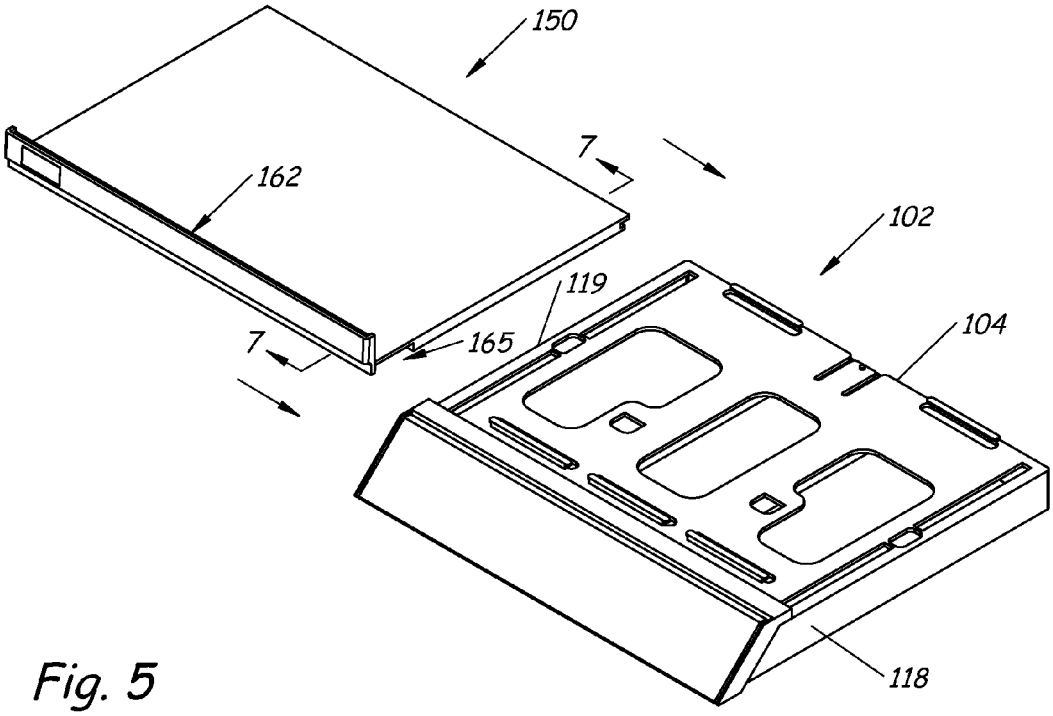
FIG. 5 is a perspective view of mounting one embodiment of an insert tray to the carrier tray assembly or base assembly illustrated in FIGS. 1 and 2.

FIG. 5 illustrates a perspective view of mounting one embodiment of an insert tray 150 to carrier tray assembly 102. As illustrated in the FIG. 6 perspective view, after insert tray 150 is mounted to carrier tray assembly 102, the combination of carrier tray assembly 102 and insert tray 150 comprises a shelf-type display module 100. As illustrated, insert tray 150 can be mounted onto carrier tray assembly 102 by sliding insert tray 150 in the direction illustrated by arrows in FIG. 5. In other words, insert tray 150 can be mounted to carrier tray assembly 102 by sliding insert tray 150 from left side 119 to right side 118 on carrier tray 104. Although not specifically illustrated, in the alternative, insert tray 150 can be mounted to carrier tray assembly 102 by sliding insert tray 150 in a direction opposite of the directional arrows illustrated in FIG. 5. In other words, insert tray 150 can be mounted to carrier tray assembly 102 by sliding insert tray 150 from right side 118 to left side 119 on carrier tray 104.

With reference back to FIG. 1, to mount insert tray 150 to carrier tray assembly 102, carrier tray 104 includes additional components for receiving and securing insert tray 150. In one embodiment, carrier tray 104 includes a plurality of tracks protruding from top 116. In particular, carrier tray 104 includes a first set of tracks 152 and 153 spaced apart and positioned in alignment with each other. In particular, the first set of tracks 152 and 153 are spaced apart across a width of carrier tray 104 and are located near back 121 of carrier tray 104. Carrier tray 104 also includes a second set of tracks 154, 155 and 156 spaced apart and positioned in alignment with each other. In particular, second set of tracks 154, 155, and 156 are spaced apart across a width of carrier tray 104 and are located near front 120 (FIG. 2) of carrier tray 104. Tracks 152, 153, 154, 155 and 156 extend from top 116 of carrier tray and are an inverted "L" shape. In other words, one of the ends of each track's "L" shape is fixed to top 116 of carrier tray 104 and the other of the ends of each track's "L" shape are free. Tracks 152, 153, 154, 155 and 156 are configured to engage with and receive corresponding mating components on an insert tray, such as insert tray 150.

In another embodiment, carrier tray includes a flexible tab 158 having a nub 159 that protrudes upwards from an upper surface of flexible tongue 158. Flexible tongue 158 is formed integrally with the material of carrier tray 104 and is defined by a continuous slit that is formed on three sides. With three free edges, flexible tongue 158 is capable of being depressed, and when released, capable of springing back into its original position.

Figure 7:
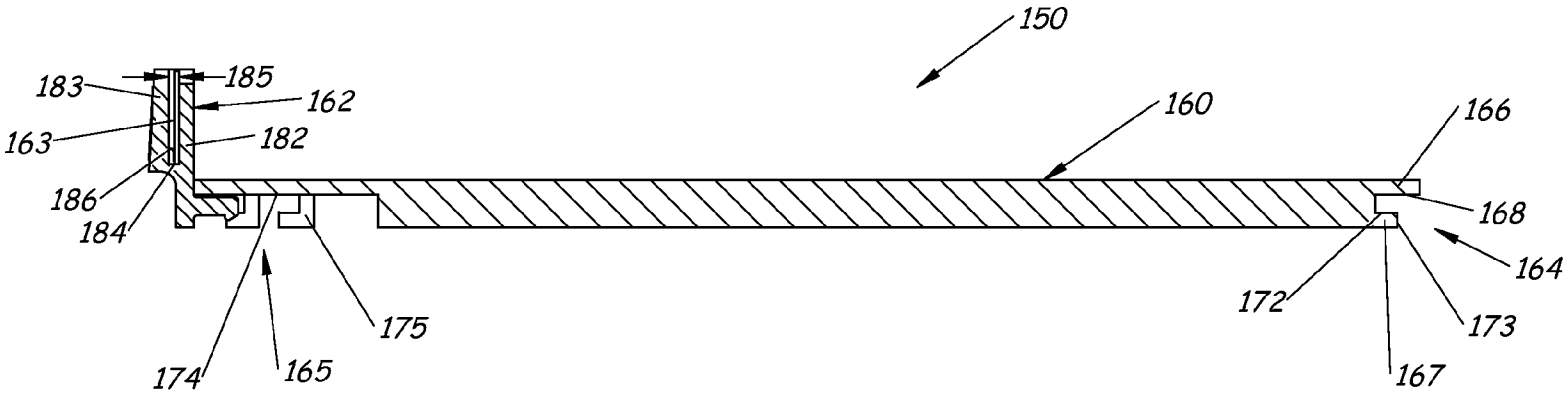
FIG. 7 is a section view of the insert tray taken through a section line indicated in FIG. 5.

FIG. 7 illustrates a section view of insert tray 150 taken along the line indicated in FIG. 5. Insert tray 150 is a flat insert tray that has a main body 160 that can be fabricated by, for example, injection molding opaque colored styrene. Fastened to a front of insert tray 150 is a label holder 162 that can also be made by injection molding, but using, for example, transparent styrene. While carrier tray assembly 102 includes fanfold extrusion 124 having label sleeves 138 and 139 that both hold the labels and hide the labels from customer view by being encased between main body 122 and cover 127, the labels located in label holder 162 are viewable by the customer at all times. In one embodiment, multiple products can be supported on insert tray 150 and therefore carrier tray 104 that are of the same brand and have the same price, but have different characteristics. For example, bottles of nail polish may be displayed on insert tray 150 that are of the same brand and size and include the same price per product; however, the bottles of nail polish can be of an assortment of different colors. Each color requires a separate label that includes product item numbers for access by store employees to perform inventory or stocking related activities. However, in some embodiments, only one label or a few labels needs to be viewable at all times that relays price information to the customer about the product. This label or labels 163 can be placed in label holder 162. In addition, temporary in-store marketing signs can also be placed within label holder 162 for when the products being displayed on insert tray 150 are undergoing a promotional incentive, such as undergoing a promotional price.

Figure 8:
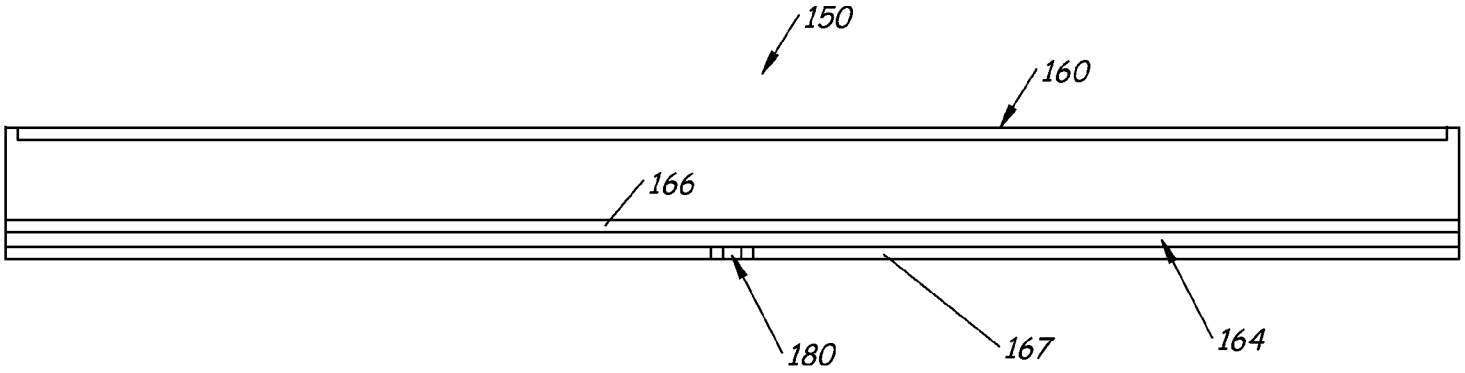
FIG. 8 is a back elevation view of the insert tray illustrated in FIG. 5.

Main body 160 of insert tray 150 also includes components for mating with tracks 152, 153, 154, 155 and 156 on carrier tray 104. In particular and as also illustrated in the back elevation view of FIG. 8, main body 160 of insert tray 150 includes a rear channel 164 that extends an entire width of insert tray 150 and a front channel 165 that extends at least a portion of an entire width of insert tray 150.

Rear channel 164 is defined by an upper leg 166 and a lower leg 167. Upper leg 166 is deeper in dimension than lower leg 167 and when insert tray 150 is being mounted to carrier tray 104, a bottom surface 168 of upper leg 166 slides along and engages top surfaces 170 and 171 (FIG. 1) of tracks 152 and 153. Furthermore, when insert tray 150 is being mounted to carrier tray 104, a top surface 172 and an end surface 173 of lower leg 167 slides along and engages under surfaces of tracks 152 and 153. Front channel 165 is defined by a bottom 174 of main body 160 and an L-shaped leg or legs 175 that protrude from bottom 174. When insert tray 150 is being mounted to carrier tray 104, bottom 174 slides along and engages top surfaces 176, 177 and 178 (FIG. 1) of tracks 154, 155 and 156. Furthermore, when insert tray 150 is being mounted to carrier tray 104, select surfaces of L-shaped leg or legs 175 slide along and engage under surfaces of tracks 154, 155 and 156.

Insert tray 150 also includes an indentation 180 (FIG. 8) in lower leg 167. Indentation 180 is located at a midpoint along the back lower leg 167 and is recessed a depth from the back of insert tray 150 into lower leg 167. Indentation 180 is configured to mate with nub 159 on flexible tongue 158 of carrier tray 104. Upon insert tray 150 sliding along tracks 152, 153, 154, 155 and 156, the flexible nature of tongue 158 allows nub 159 to also ride along insert tray 150 until indentation 180 engages with nub 159 and locks insert tray 150 to carrier tray 104. To release insert tray 150, nub 159, and therefore tongue 158, is depressed and insert tray 150 is again allowed to ride along tracks 152, 153, 154, 155 and 156 and be removed from carrier tray 104.

Figure 6:
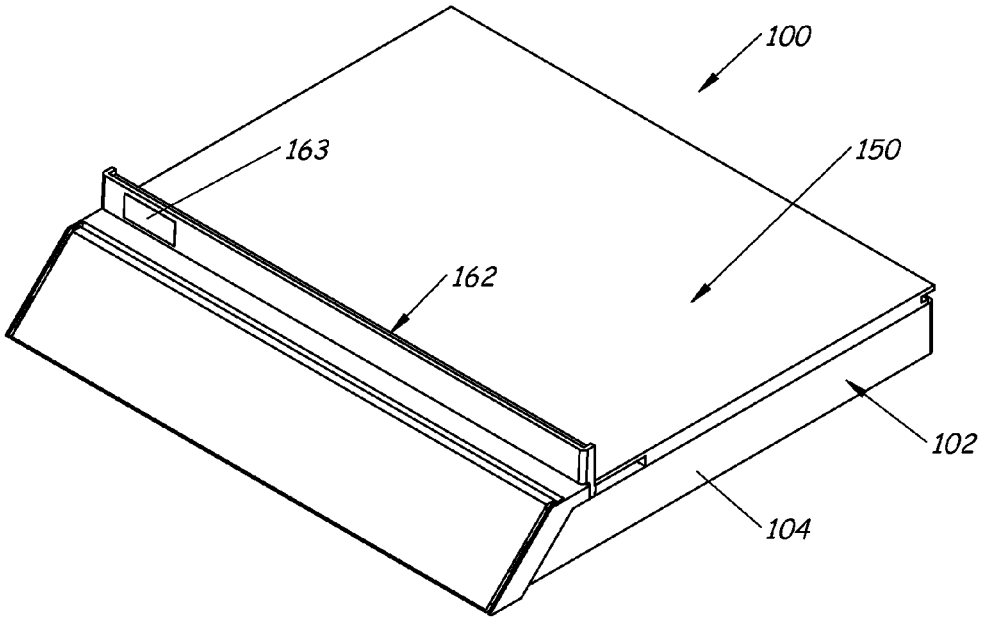
FIG. 6 is a perspective view of one embodiment of a shelf-type display module including the insert tray of FIG. 5 mounted to the carrier tray assembly or base assembly illustrated in FIGS. 1 and 2.

Label holder 162 (FIGS. 5-7) of insert tray 150 includes a back component 182 connected to a front component 183 (FIG. 7) by a bottom connecting piece 184 (FIG. 7) to define a slot. Back component 182, front component 183 and bottom connecting piece 184 (and therefore also the slot) extend almost the entire width of insert tray 150 as illustrated in FIGS. 5 and 6. Bottom connecting piece 184 encloses the bottom of the slot of the label holder 162, while a distance 185 of the slot is between back component 182 and front component 183 provides an opening in the top of label holder 162 for label(s) 163 to slide into label holder 162. In addition, label holder 162 includes a plurality of ramps 186 (FIG. 7) located in the slot that are spaced apart from each other along the width of label holder 162. Each ramp 186 includes an arc that extends from an inner surface of front component 183 to an inner surface of bottom connecting piece 184. As such, when label(s) 163 is inserted into the opening in the slot, the bottom edge of the label(s) 163 rides along the arc of a ramp 186 to engage and be held by the inner surface of bottom connecting piece 184 and between ramps 186 and an inner surface of back component 182.

Figure 9:
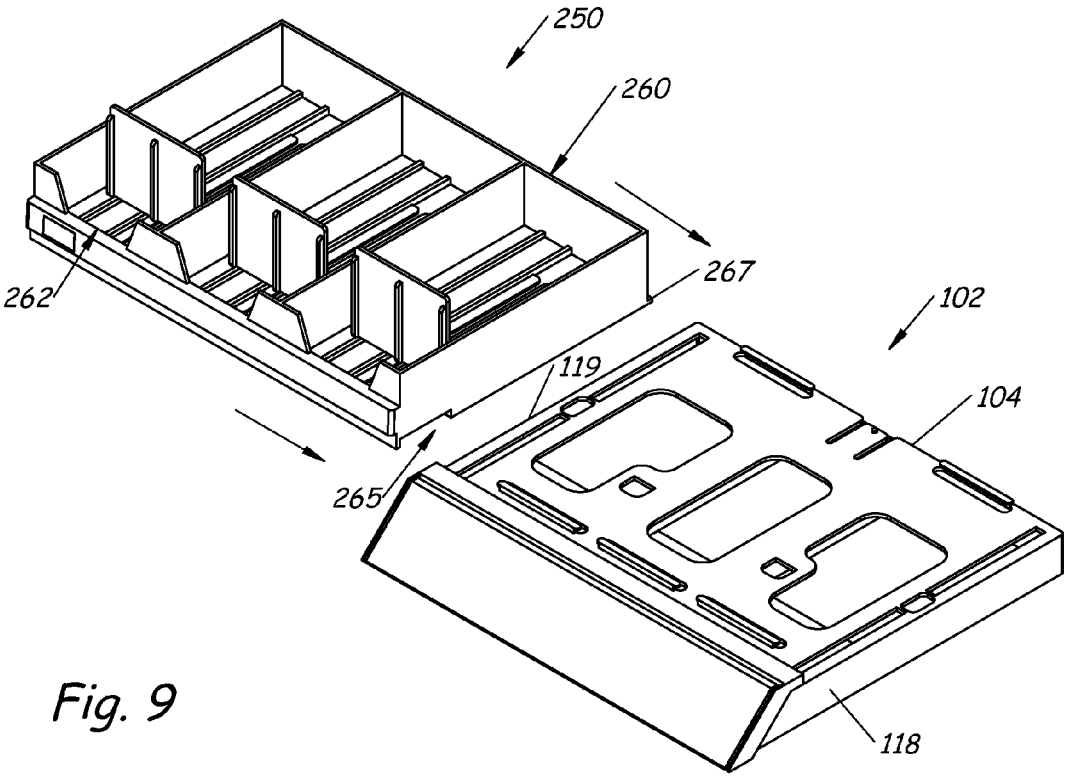
FIG. 9 is a perspective view of mounting another embodiment of an insert tray to the carrier tray assembly or base assembly illustrated in FIGS. 1 and 2.
Figure 10:
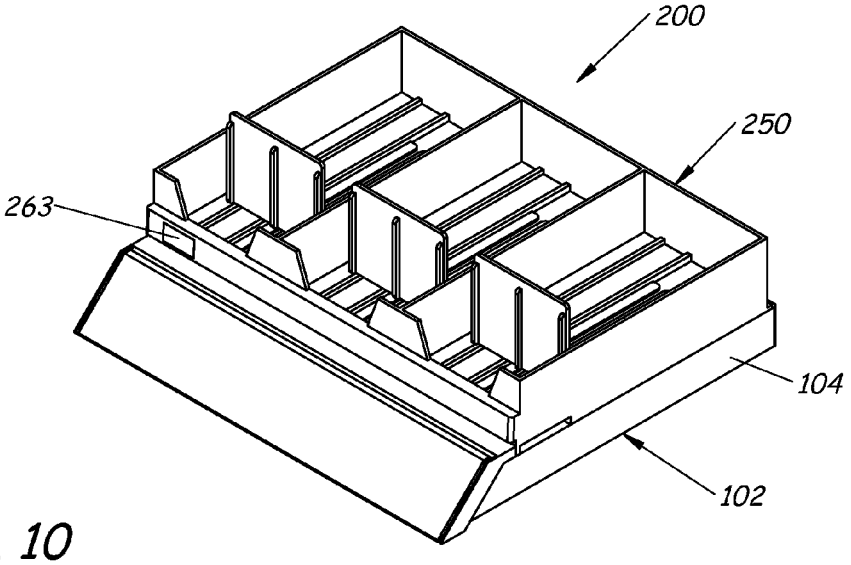
FIG. 10 is a perspective view of another embodiment of a shelf-type display module including the insert tray of FIG. 9 mounted to the carrier tray assembly or base assembly illustrated in FIGS. 1 and 2.

FIG. 9 illustrates a perspective view of mounting another embodiment of an insert tray 250 to carrier tray assembly 102. As illustrated in the FIG. 10 perspective view, when insert tray 250 is mounted to carrier tray assembly 102, the combination of carrier tray assembly 102 and insert tray 250 is a display fixture 200. As illustrated, insert tray 250 can be mounted to carrier tray assembly 102 by sliding insert tray 250 in the direction illustrated by arrows in FIG. 9. In other words, insert tray 250 can be mounted to carrier tray assembly 102 by sliding insert tray 250 from left side 119 to right side 118 on carrier tray 104. Although not specifically illustrated, in the alternative, insert tray 250 can be mounted to carrier tray assembly 102 by sliding insert tray 250 in a direction opposite of the directional arrows illustrated in FIG. 9. In other words, insert tray 250 can be mounted to carrier tray assembly 102 by sliding insert tray 250 from right side 118 to left side 119 on carrier tray 104.

Figure 11:
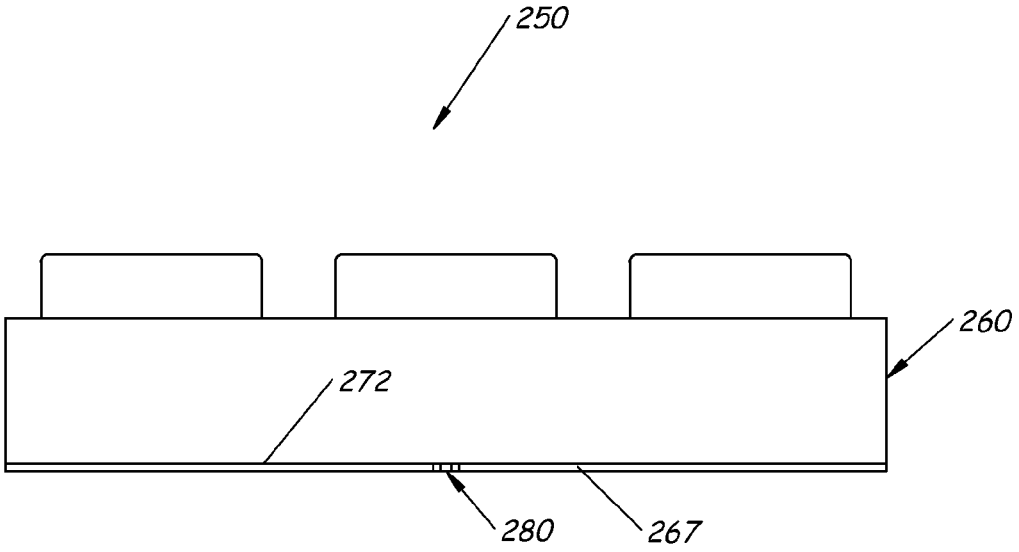
FIG. 11 is a back elevation view of the insert tray illustrated in FIG. 9.

Insert tray 250 is a pusher tray and includes a main body 260 that can be fabricated by injection molding transparent styrene. Main body 260 includes components for holding product for display and for mating with tracks 152, 153, 154, 155 and 156 on carrier tray 104. While insert tray 250 illustrates three channels each having a pusher mechanism for pushing product forward, pusher trays can come in various configurations including four or more channels each having a pusher mechanism. Insert tray 250, including other configurations of pusher trays, includes a label holder 262. In addition, main body 260 of insert tray 250 includes a lip or leg 267 (as illustrated in the back elevation view of FIG. 11) that extends an entire width of the back side of insert tray 250 and a front channel 265.

When insert tray 250 is being mounted to carrier tray 104, a top surface 272 of lip 267 slides along and engages under surfaces of tracks 152 and 153. Front channel 265 is similar in construction to channel 165 and defined by components of main body 260, which slide along and engage top surfaces 176, 177 and 178 and under surfaces of tracks 154, 155 and 156.

Insert tray 250 also includes an indentation 280 (FIG. 11) in lip or leg 267. Indentation 280 is located at a midpoint along lip or leg 267 and is recessed a depth from the back of insert tray 250 into lip or leg 267. Indentation 280 is configured to mate with nub 159 on flexible tongue 158 of carrier tray 104. Upon insert tray 250 sliding along tracks 152, 153, 154, 155 and 156, the flexible nature of tongue 158 allows nub 159 to also ride along insert tray 250 until indentation 280 mates with nub 159 and locks insert tray 250 to carrier tray 104. To release insert tray 250, nub 159 and tongue 158 are depressed and insert tray 250 is again allowed to ride along tracks 152, 153, 154, 155 and 156 to be removed from carrier tray 104.

Label holder 262 is similar to label holder 162 of insert tray 150 in that label holder 262 is viewable at all times by a customer and includes label(s) 263 that relays price information. In addition, like label holder 162, label holder 262 also includes a back leg, a front leg and a connecting bottom piece that define a slot as well as spaced apart ramps for holding label(s) 263 in place. In accordance with some embodiments, label holder 262 is not a separate piece that is fastened to the front insert tray 250. Rather, label holder 262 is formed with main body 260 of insert tray 250 since both are made of a transparent material.

Figure 12:
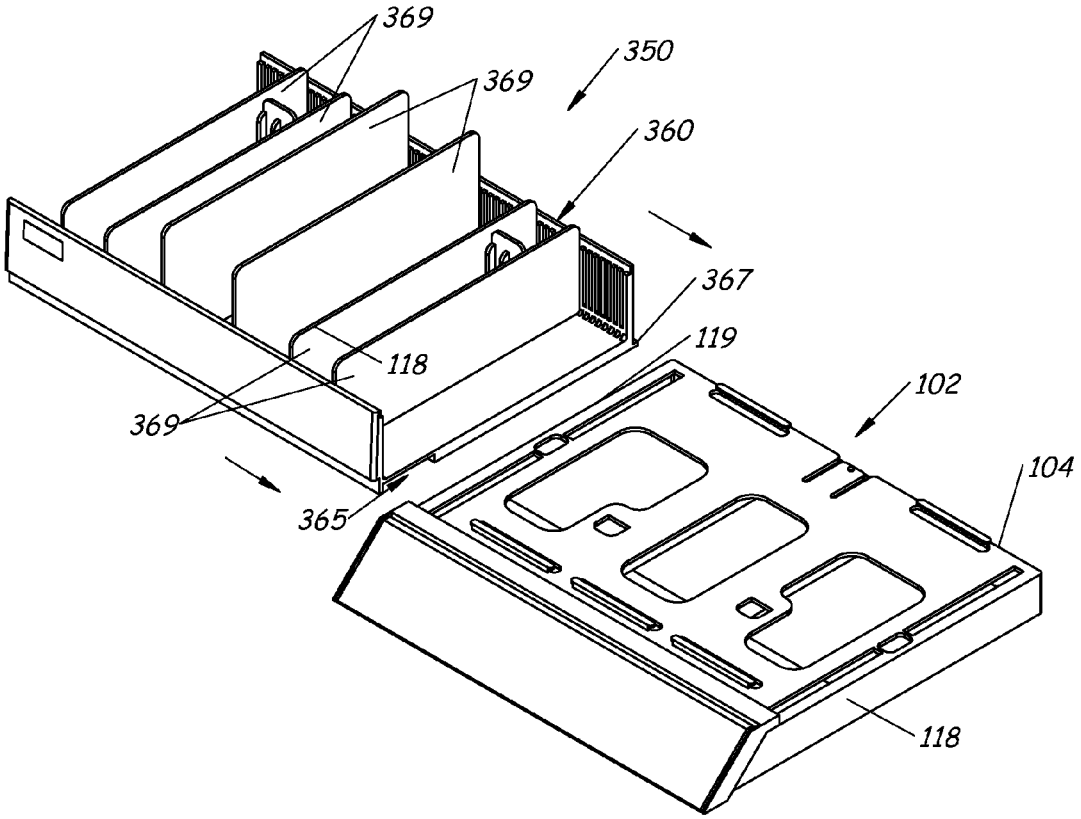
FIG. 12 is a perspective view of mounting yet another embodiment of an insert tray to the carrier tray assembly or base assembly illustrated in FIGS. 1 and 2.
Figure 13:
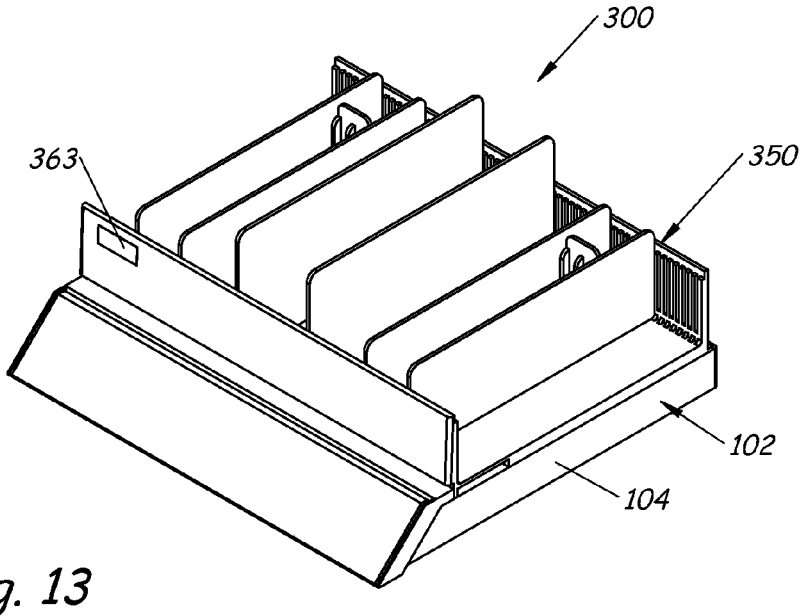
FIG. 13 is a perspective view of yet another embodiment of a shelf-type display module including the insert tray of FIG. 12 mounted to the carrier tray assembly or base assembly illustrated in FIGS. 1 and 2.

FIG. 12 illustrates a perspective view of mounting yet another embodiment of an insert tray 350 to carrier tray assembly 102. As illustrated in the FIG. 13 perspective view, after insert tray 350 is mounted to carrier tray assembly 102, the combination of carrier tray assembly 102 and insert tray 350 comprises a display fixture 300. As illustrated, insert tray 350 can be mounted to carrier tray assembly 102 by sliding insert tray 350 in the direction illustrated by arrows in FIG. 12. In other words, insert tray 350 can be mounted to carrier tray assembly 102 by sliding insert tray 350 from left side 119 to right side 118 on carrier tray 104. Although not specifically illustrated, in the alternative, insert tray 350 can be mounted to carrier tray assembly 102 by sliding insert tray 350 in a direction opposite of the directional arrows illustrated in FIG. 12. In other words, insert tray 350 can be mounted to carrier tray assembly 102 by sliding insert tray 350 from right side 118 to left side 119 on carrier tray 104.

Insert tray 350 is a utility tray and includes a main body 360 that can be fabricated by injection molding transparent styrene. Main body 360 includes components for holding products for display and for mating with tracks 152, 153, 154 and 156 on carrier tray 104. While insert tray 350 illustrates the utility tray having six removable dividers 369 for dividing the utility tray into seven rows, the utility tray can utilize any number of removable dividers for dividing the utility tray into any number of rows. Main body 360 includes a similar lip or leg 367 to lip or leg 267 of main body 260 of insert tray 250 including an indentation, such as indentation 280. Main body 360 also includes a front channel 365 that is similar to front channel 265 of main body 260. Like insert tray 250, when insert tray 350 is being mounted to carrier tray 104, a top surface of lip or leg 367 slides along and engages under surfaces of tracks 152 and 153. Front channel 365 is defined by components of main body 360, which slide along and engage top surfaces 176, 177 and 178 and under surfaces of tracks 154, 155 and 156. Likewise, the indentation in lip or leg 367 engages with nub 159 on flexible tongue 158 of carrier tray 104 to lock insert tray 350 to carrier tray 104 as well as similarly disengaging with nub 159 to unlock insert tray 350 from carrier tray 104.

Insert tray 350 like other configurations of utility trays includes a label holder 362. Label holder 362 is similar to label holder 162 of insert tray 150 and label holder 262 of insert tray 250 in that label holder 362 is viewable by a customer at all times and includes a label(s) 363 that relays price information to the customer. In addition, like label holders 162 and 262, label holder 362 also includes a back leg, a front leg and a connecting bottom piece that define a slot as well as spaced apart ramps for holding label(s) 363 in place. In accordance with some embodiments, label holder 362 is not a separate piece that is fastened to the front of insert tray 350. Rather, label holder 362, like label holder 262, is formed as a single piece with main body 360 of insert tray 350 since both are made of a transparent material.

Figure 14:
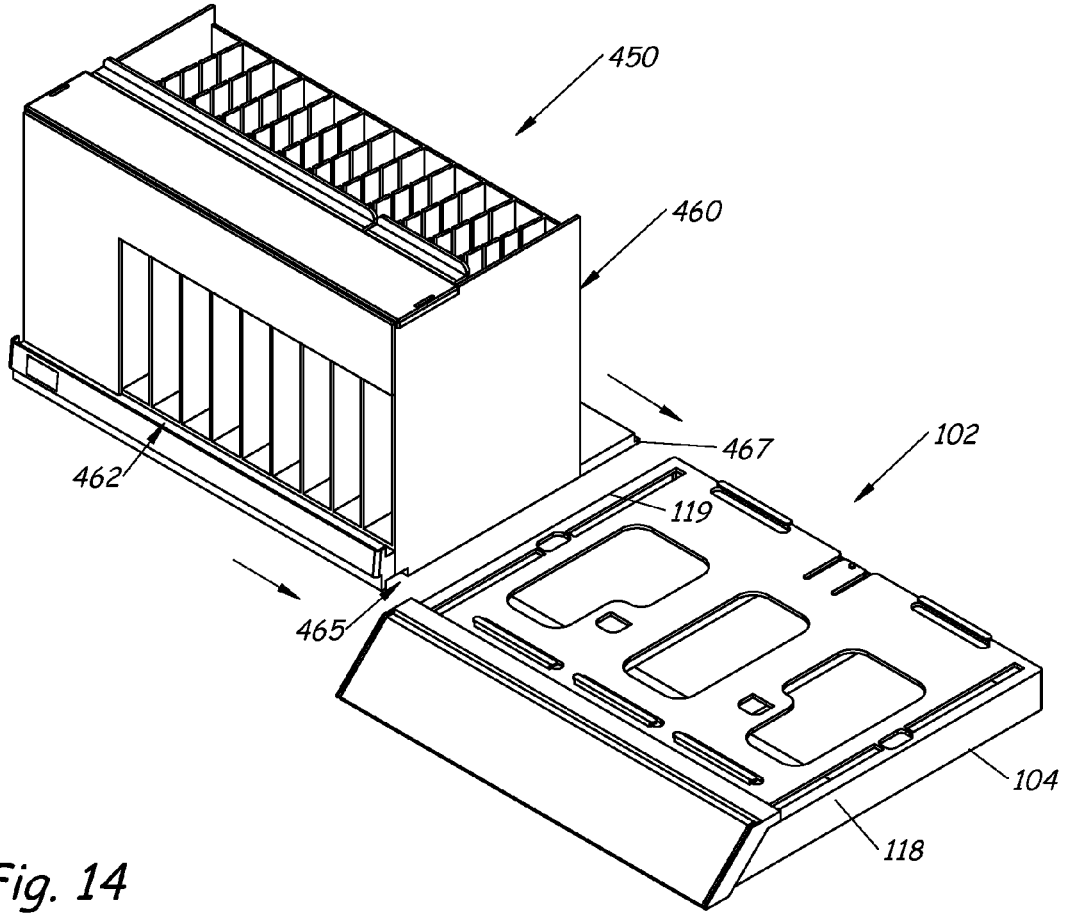
FIG. 14 is a perspective view of mounting yet another embodiment of an insert tray to the carrier tray assembly or base assembly illustrated in FIGS. 1 and 2.
Figure 15:
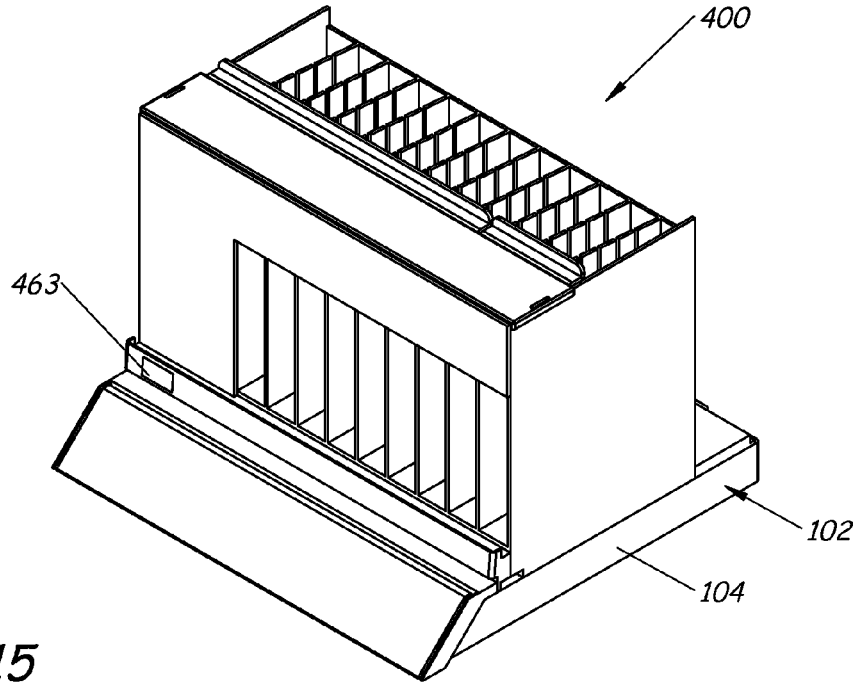
FIG. 15 is a perspective view of yet another embodiment of a shelf-type display module including the insert tray of FIG. 14 mounted to the carrier tray assembly or base assembly illustrated in FIGS. 1 and 2.

FIG. 14 illustrates a perspective view of mounting yet another embodiment of an insert tray 450 to carrier tray assembly 102. As illustrated in the FIG. 15 perspective view, after insert tray 450 is mounted to carrier tray assembly 102, the combination of carrier tray assembly 102 and insert tray 450 comprises a display fixture 400. As illustrated, insert tray 450 can be mounted to carrier tray assembly 102 by sliding insert tray 450 in the direction illustrated by arrows in FIG. 14. In other words, insert tray 450 can be mounted to carrier tray assembly 102 by sliding insert tray 450 from left side 119 to right side 118 on carrier tray 104. Although not specifically illustrated, in the alternative, insert tray 450 can be mounted to carrier tray assembly 102 by sliding insert tray 450 in a direction opposite of the directional arrows illustrated in FIG. 14. In other words, insert tray 450 can be mounted to carrier tray assembly 102 by sliding insert tray 450 from right side 118 to left side 119 on carrier tray 104.

Insert tray 450 is a cubby tray for holding product and includes a main body 460 that can be fabricated by injection molding transparent styrene. Main body 460 includes components for holding products for display and for mating with tracks 152, 153, 154, 155 and 156 on carrier tray 104. While insert tray 450 illustrates the cubby tray having twelve rows, the cubby tray can utilize any number of rows. Main body 460 includes a similar lip or leg 467 to lip or leg 267 of main body 260 of insert tray 250 including an indentation, such as indentation 280. Main body 460 also includes a front channel 465 that is similar to front channel 265 of main body 260. Like insert trays 250 and 350, when insert tray 450 is being mounted to carrier tray 104, a top surface of leg or lip 467 slides along and engages under surfaces of tracks 152 and 153. Front channel 465 is defined by components of main body 460, which slide along and engage top surfaces 176, 177 and 178 and under surfaces of tracks 154, 155 and 156. Likewise, the indentation in lip or leg 467 engages with nub 159 on flexible tongue 158 of carrier tray 104 to lock insert tray 450 to carrier tray 104 as well as similarly disengaging with nub 159 to unlock insert tray 450 from carrier tray 104.

Insert tray 450, like other configurations of cubby trays, includes a label holder 462. Label holder 462 is similar to label holder 162 of insert tray 150, label holder 262 of insert tray 250 and label holder 362 of insert tray 350 in that label holder 462 is viewable by a customer at all times and includes a label(s) 463 that relays price information to the customer. In addition, like label holders 162, 262 and 362, label holder 462 also includes a back leg, a front leg and a connecting bottom piece that define a slot as well as spaced apart ramps for holding label 463 in place. In accordance with some embodiments, label holder 462 is not a separate piece that is fastened to the front insert tray 450. Rather, label holder 462, like label holders 262 and 362, is formed as a single piece with main body 460 of insert tray 450 since both are made of a transparent material.

Figure 16:
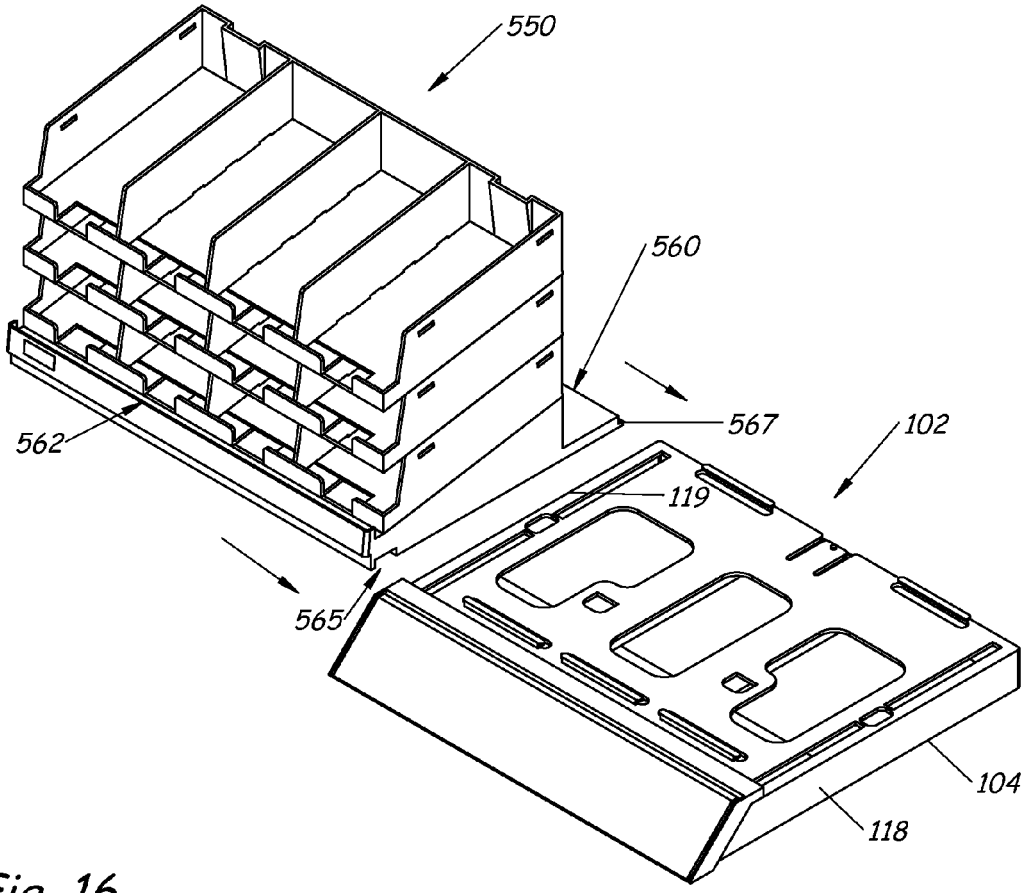
FIG. 16 is a perspective view of mounting yet another embodiment of an insert tray to the carrier tray assembly or base assembly illustrated in FIGS. 1 and 2.
Figure 17:
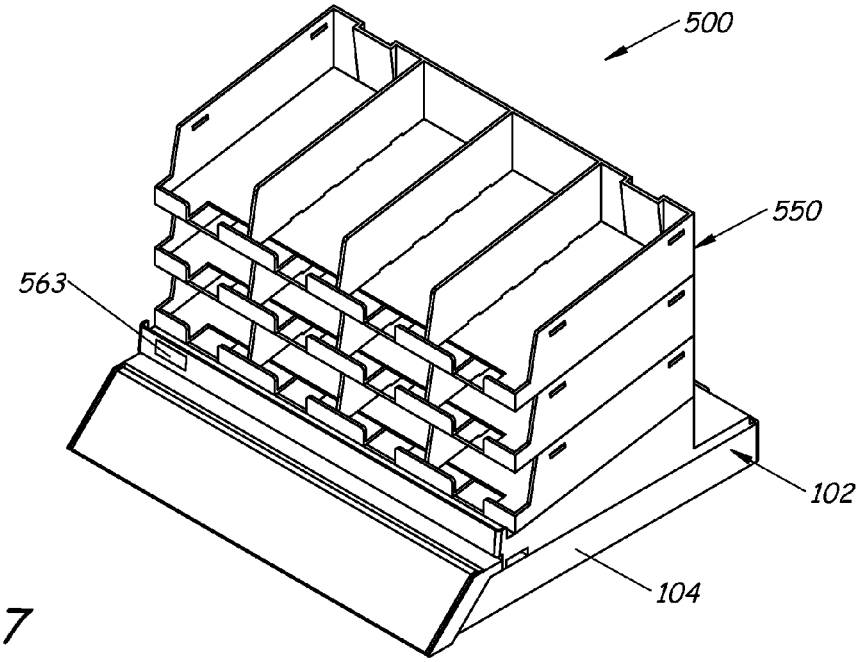
FIG. 17 is a perspective view of yet another embodiment of a shelf-type display module including the insert tray of FIG. 16 mounted to the carrier tray assembly or base assembly illustrated in FIGS. 1 and 2.

FIG. 16 illustrates a perspective view of mounting yet another embodiment of an insert tray 550 to carrier tray assembly 102. As illustrated in the FIG. 17 perspective view, after insert tray 550 is mounted to carrier tray assembly 102, the combination of carrier tray assembly 102 and insert tray 550 comprises a display fixture 500. As illustrated, insert tray 550 can be mounted to carrier tray assembly 102 by sliding insert tray 550 in the direction illustrated by arrows in FIG. 16. In other words, insert tray 550 can be mounted to carrier tray assembly 102 by sliding insert tray 550 from left side 119 to right side 118 on carrier tray 104. Although not specifically illustrated, in the alternative, insert tray 550 can be mounted to carrier tray assembly 102 by sliding insert tray 550 in a direction opposite of the directional arrows illustrated in FIG. 16. In other words, insert tray 550 can be mounted to carrier tray assembly 102 by sliding insert tray 550 from right side 118 to left side 119 on carrier tray 104.

Insert tray 550 is a gravity feed tray and includes a main body 560 that can be fabricated by injection molding transparent styrene. Main body 560 includes components for holding products for display and for mating with tracks 152, 153, 154, 155 and 156 on carrier tray 104. While insert tray 550 illustrates the gravity feed tray having four rows, the gravity feed tray can utilize any number of rows. Main body 560 includes a similar lip or leg 567 to main body 260 of insert tray 250, main body 360 of insert tray 350 and main body 460 of insert tray 450 including an indentation, such as indentation 280. Main body 560 also includes a front channel 365 that is similar to front channel 265 of main body 260. Like insert trays 250, 350 and 450, when insert tray 550 is being mounted to carrier tray 104, a top surface of lip or leg 567 slides along and engages under surfaces of tracks 152 and 153. Front channel 565 is defined by components of main body 560, which slide along and engage top surfaces 176, 177 and 178 and under surfaces of tracks 154, 155 and 156. Likewise, the indentation in lip 567 engages with nub 159 on flexible tongue 158 of carrier tray 104 to lock insert tray 550 to carrier tray 104 as well similarly disengaging with nub 159 to unlock insert tray 550 from carrier tray 104.

Insert tray 550, like other configurations of gravity feed trays, includes a label holder 562. Label holder 562 is similar to label holder 162 of insert tray 150, label holder 262 of insert tray 250, label holder 362 of insert tray 350 and label holder 462 of insert tray 460 in that label holder 562 is viewable by customers at all times and includes label(s) 563 that relays price information to the customer. In addition, like label holders 162, 262, 362 and 462, label holder 562 also includes a back leg, a front leg and a connecting bottom piece that define a slot as well as spaced apart ramps for holding label 563 in place. In accordance with some embodiments, label holder 562 is not a separate piece that is fastened to the front insert tray 550. Rather, label holder 562, like label holders 262, 362 and 462, is formed as a single piece with main body 560 of insert tray 550 since both are made of a transparent material.

Figure 18:
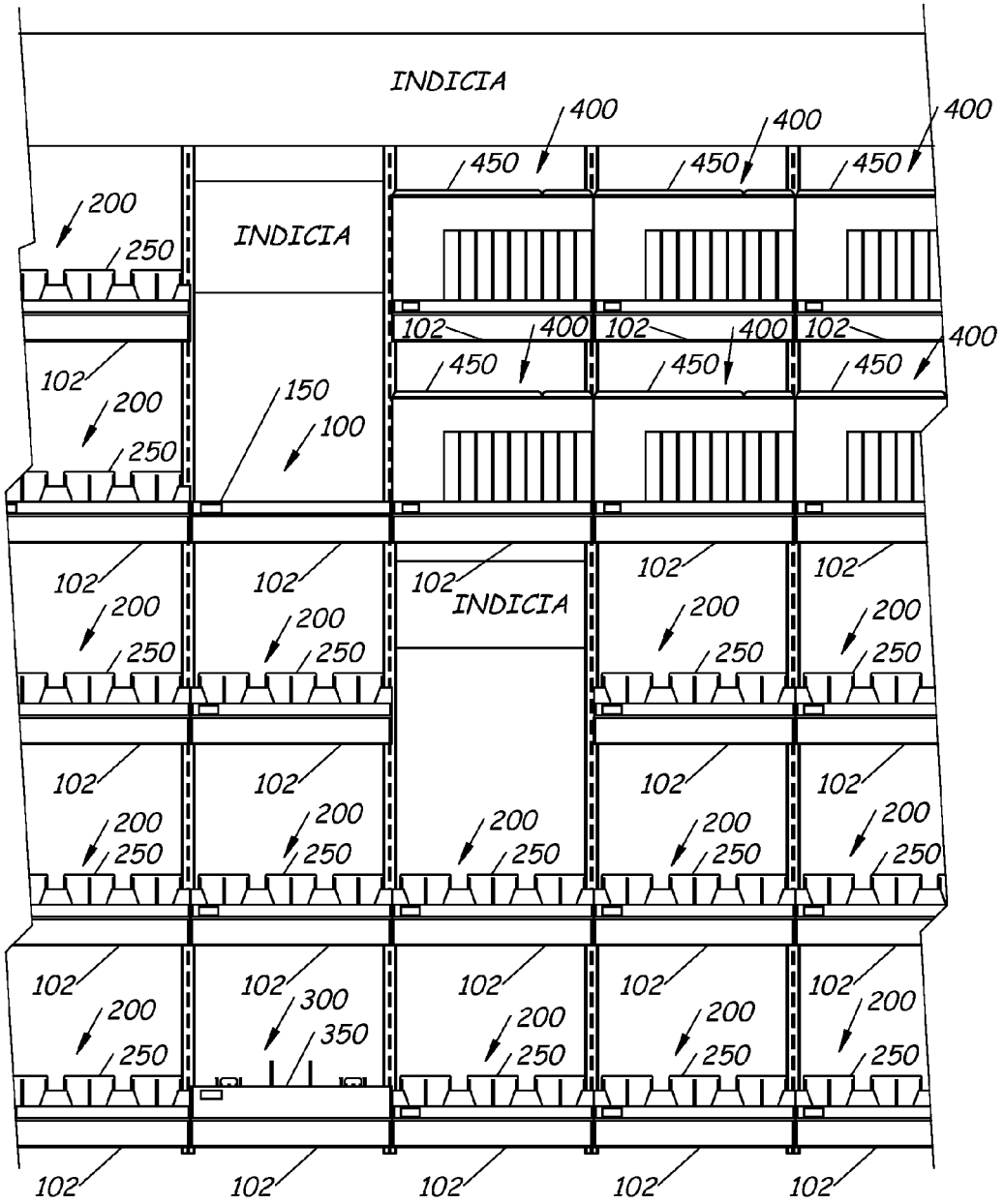
FIG. 18 is a front view of a display fixture including a plurality of shelf-type display modules mounted to uprights of a display unit in a retail store.

FIG. 18 is a front elevation view of a plurality of shelf-type display modules all mounted to concealed standards on a powered wall panel, which is coupled to a wall of a display unit, such as a gondola display unit. Exemplary shelf-type display modules include shelf-type display module 100 including carrier tray assembly 102 and insert tray 150, a plurality of shelf-type display modules 200 each including carrier tray assembly 102 and insert tray 250, shelf-type display module 300 including carrier tray assembly 102 and insert tray 350 and plurality of shelf-type display modules 400 each including carrier tray assembly 102 and insert tray 450. Together lights 112 in each carrier tray assembly 102 cast light downward to illuminate the display fixture for both highlighting products for purchase as well as highlighting labels in label holders that are viewable to the customer.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display shelf comprising:

a base for supporting product in a retail store;

a detachable front assembly comprising:

a main body detachably mounted to a front of the base;

a fanfold extrusion housed in the main body of the detachable front assembly, the fanfold extrusion including at least two label sleeves for receiving labels that provide relevant information to employees about the products being supported by the base; and a cover comprising a lens mounted to a lens back plate and being rotatably coupled to the main body to enclose and hide the fanfold extrusion within the main body, wherein a graphic is sandwiched between the lens and the lens back plate and provides relevant information to customers about the products being supported by the base.

2. The display shelf of claim 1, wherein the main body of the detachable front assembly comprises an angled component and an upper component, wherein a back of the angle component mounts to the front of the base and wherein a bottom of the upper component mounts to a top of the base.

3. The display shelf of claim 2, wherein the upper component of the main body comprises a transparent material, the transparent material of the upper component transmits light that shines upwardly from at least one light attached to a bottom of the base and through an opening in the base.

4. The display shelf of claim 1, wherein the fanfold extrusion comprises a single, continuous extruded material having a first label sleeve coupled to a second label sleeve by a hinge.

5. The display shelf of claim 4, wherein the first label sleeve comprises a front piece coupled to a back piece by a bottom connecting piece, wherein the bottom connecting piece of the first label sleeve encloses a bottom of the first label sleeve and wherein the front piece and the back piece of the first label sleeve bias together to hold at least one label in place.

6. The display shelf of claim 5, wherein the second label sleeve comprises a front piece coupled to a back piece by a bottom connecting piece, wherein the bottom connecting piece of the second label sleeve encloses a bottom of the second label sleeve and wherein the front piece and the back piece of the second label sleeve bias together to hold at least one label in place.

7. The display shelf of claim 1, wherein the base is coupled to uprights on a gondola display unit using a pair of shelf brackets that are mounted to the base.

8. A display shelf comprising:

a base having a front side;

a front body attached to the front side of the base and including an angled component mounted to the front side of the base and an upper component mounted to a top of the base;

at least one label sleeve attached to the front body; and a cover rotatably coupled to the front body and enclosing the at least one label sleeve, wherein the cover includes a graphic that provides relevant information to customers about products being supported by the base;

wherein the upper component of the front body comprises a transparent material that transmits light that shines upwardly from at least one light attached to a bottom of the base and through an opening in the base.

9. The display shelf of claim 8, wherein the at least one label sleeve and the hinge are made of a single, continuous extrusion.

10. The display shelf of claim 8, wherein the at least one label sleeve comprises a front piece coupled to a back piece by a bottom connecting piece, wherein the bottom connecting piece encloses a bottom of the at least one label sleeve and wherein the front piece and the back piece of the at least one label sleeve bias together to hold at least one label in place.

11. The display shelf of claim 8, wherein the cover comprises a lens mounted to a lens back plate, wherein the graphic is located between the lens and the lens back plate.

12. The display shelf of claim 8, wherein the front side of the base is angled and the angled component of the front body is mounted to the angled front side of the base.

13. The display shelf of claim 8, wherein the base is coupled to uprights on a gondola display unit using a pair of shelf brackets that are mounted to the base.

14. A method of accessing labels on a display shelf, the method comprising:

lifting a cover that is rotatably coupled to a front body and is attached to a front side of a display shelf from a closed position to an opened position, wherein the cover includes a transparent lens, a lens back plate and a graphic located between the transparent lens and the lens back plate, wherein the graphic provides relevant information to customers about products being supported by the display shelf; and rotating a first transparent label sleeve holding at least one price label about a hinge that connects the first transparent label sleeve to a second transparent label sleeve holding another at least one price label, wherein the first and second transparent label sleeves and the hinge are made of a single, continuous extrusion and are located behind the cover.

15. The method of claim 14, further comprising viewing the at least one price label located in the second transparent label sleeve.

16. The method of claim 14, further comprising scanning with a scanner the at least one price label that is located in the second transparent label sleeve.

17. The method of claim 14, further comprising releasing the cover that is rotatably coupled to the front body and is attached to the front side of the display shelf so that the cover returns to a closed position.

* * * * *